United States Patent [19]

Rogers

[11] 4,276,121

[45] Jun. 30, 1981

[54] COKE OVEN DOOR SPILLAGE COLLECTION AND DISPOSAL APPARATUS

[75] Inventor: Robert C. Rogers, Pittsburgh, Pa.

[73] Assignee: Koppers Company, Inc., Pittsburgh, Pa.

[21] Appl. No.: 189,372

[22] Filed: Sep. 22, 1980

[51] Int. Cl.[3] ..... C10B 39/04; C10B 43/04; C10B 33/10; C10B 25/12

[52] U.S. Cl. ..... 202/227; 202/241; 202/262; 202/270; 202/248; 414/212; 414/215

[58] Field of Search ..... 202/227, 241, 248, 262, 202/270; 414/209, 212, 214, 215; 201/2, 39

[56] References Cited

U.S. PATENT DOCUMENTS

| | | | |
|---|---|---|---|
| 2,224,392 | 12/1940 | Imes | 414/212 X |
| 3,930,961 | 1/1976 | Sustarsic et al. | 202/227 |
| 3,990,949 | 11/1976 | Ovyannikov | 202/241 |
| 4,166,007 | 8/1979 | Becker, Jr. | 202/262 |

*Primary Examiner*—Frank W. Lutter
*Assistant Examiner*—Roger F. Phillips
*Attorney, Agent, or Firm*—R. Lawrence Sahr

[57] ABSTRACT

An extendible hopper is mounted to the undercarriage of a pusher machine and is operable to be extended to engage the face of the coke oven battery, between the buckstays and just below the door jamb, to catch hot coke that spills out of coke ovens as the door is removed and the pusher ram is retracted. A bin is also mounted to the undercarriage of the pusher machine to receive the hot coke collected by the extendible hopper. Quench sprays are mounted to the bin to quench the hot coke, and suction means are mounted to the bin to draw off pollutants that emanate from the hot coke and the quench thereof.

8 Claims, 5 Drawing Figures

COKE OVEN DOOR SPILLAGE COLLECTION AND DISPOSAL APPARATUS

BACKGROUND OF THE INVENTION

1. Field of the Invention

This invention relates to the manufacture of coke in slot-type coke oven batteries and more specifically to the clean-up of coke spilled during the pushing operations.

2. Description of the Prior Art

In the modern manufacture of coke it is conventional to use a battery, or series, or horizontal slot-type coke ovens to carbonize the coal in the production of either metallurgical or foundry grades of coke. The coal is loaded into these ovens from either an overhead larry car system or a pipeline charging system. Each of the ovens is generally in the form of a slot, for example, dimensions of 12 feet in height, 18 inches in width and 40 feet in length might be found. The coal is generally introduced through holes or ports in the top. The ends of the slots are covered with doors, including seals, to prevent the introduction of air and the leakage of gas during the coking cycle. After the coal is loaded in, it is leveled by conventional equipment, which will not be described, and heated at substantially elevated temperature for a sustained period to time, for example 1,200° F. for 18 hours. Once this coking cycle has been completed, the doors on both ends of the slot are removed. A conventional pusher machine is positioned at the pusher side of the oven and a coke guide is positioned at the opposite, or coke side, of the oven slot. A pusher ram is mounted on the pusher machine and is operable to horizontally extend through the length of the oven, functioning to push substantially all of the coke in the oven through the coke guide on the opposite side, or coke side, of the oven, into an awaiting quench car.

As mentioned above, at the end of the coke cycle, the doors are removed from both the coke side and pusher side of the oven. This is accomplished by mechanisms referred to as door machines. On the pusher side of the machine, a door extractor is usually incorporated into the pusher machine. During the door removal, some hot coke spills from the ends of the ovens onto the benches, which are horizontal shelf-like projections, extending outwardly from both the pusher side and the coke side of the battery.

The pusher ram includes an extension arm which is usually operated on a rack and pinion principle, the extension being the rack and the pinion being power driven by an electric motor mounted on the pusher machine. At the lead end of the extension arm is a ram head which is generally shaped to conform to the cross-section of the oven, although the ram head is smaller in dimension to allow for clearances as well as thermal expansion of the metal composition of the ram head. The ram head presents a flat face which pushes the red-hot incandescent coke in the coke oven through the coke side door, as mentioned above.

Because of the required clearances and the non-uniform thermal movement of the ram head, as well as the extension arm, some of the hot coke falls behind the ram head and ram shoe, on the opposite side from the flat face. Thus, when the pusher ram is retracted from the coke oven, the hot coke behind the ram head and ram shoe is dragged out of the pusher side door to fall onto the pusher side bench. As soon as this hot coke, as well as that which fell out of the oven when the door was removed, comes into contact with the air, it begins to burn, expelling noxious gases which have been determined to be pollutants. This coke continues to burn until the pusher machine is moved to another oven, following the door cleaning and replacement, and a man climbs up onto the bench and puts it out. However, recent governmental regulations have now curtailed the utilization of manpower on or near coke oven batteries. The result is that the coke burns on the bench until it is consumed. On the other hand, governmental regulations now substantially restrict the emination of pollutants from coke oven batteris, including those expelled from the burning coke on the bench. Thus, non-human means are needed to handle this bench coke expeditiously in order to curtail the pollution problem.

SUMMARY OF THE INVENTION

An extendable hopper is mounted to the pusher machine and positioned at a level beneath the pusher ram and the coke oven doors. When the pusher machine is aligned with a given oven to be pushed, the hopper is extended to come into contact with the battery. The door extractor then removes the door. The coke that spills out falls into the hopper. Next the pusher ram is extended through the oven to push the coke, and then it is retracted. The residual coke, which is dragged out behind the pusher head and ram shoe, also falls into the hopper. The hopper is then retracted and the hot coke is emptied therefrom into a bin where it is sprayed with quench water to cool it. The cooled coke is accumulated in the bin until it is convenient for the pusher machine to move it to a discharge area. The spent quench water drains from the bottom of the bin and is conducted away. Means are also provided to conduct the quench steam and airborne particulate away from the bin for containment and pollutant removal.

These and other features of the present invention will be more completely disclosed and described in the following specification, the accompanying drawings and the appended claims.

DETAILED DESCRIPTION

Figure 1:
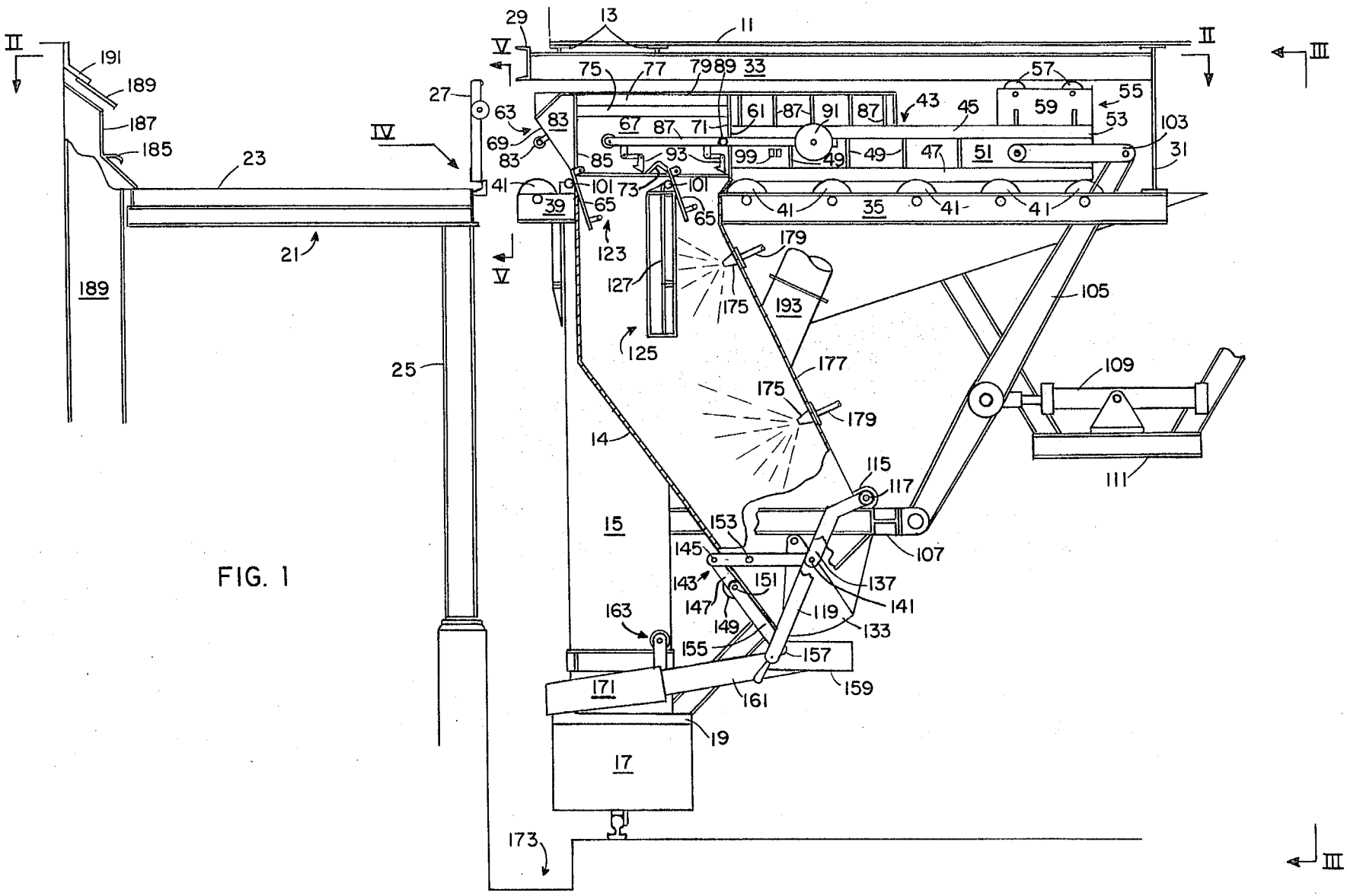
FIG. 1 is a side elevation view of the invention, partially cut away to expose the functional elements thereof.

Referring to FIG. 1, the pusher machine floor 11 is shown fixed to the floor beams 13. One of the leg supports 15 of the pusher machine is shown with its corresponding traction drive motor support 17 fixed to the support base 19. Interposed between the pusher machine and the coke oven battery is the pusher side bench 21 which is composed of the bench platform 23 and the bench supports 25. At the outer edge of the bench platform 23, adjacent the pusher machine, is a hand railing assembly 27 which will be described in detail hereinafter.

Structural members 29 and 31 form part of the undercarriage of the pusher machine, member 29 being a channel and member 31 being an I-beam. Welded between members 29 and 31 is a guide rail 33 which is positioned horizontally and is longitudinally aligned with the pusher ram (not shown) of the pusher machine. Guide rail 33 in the preferred embodiment is a structural H-beam.

Figure 2:
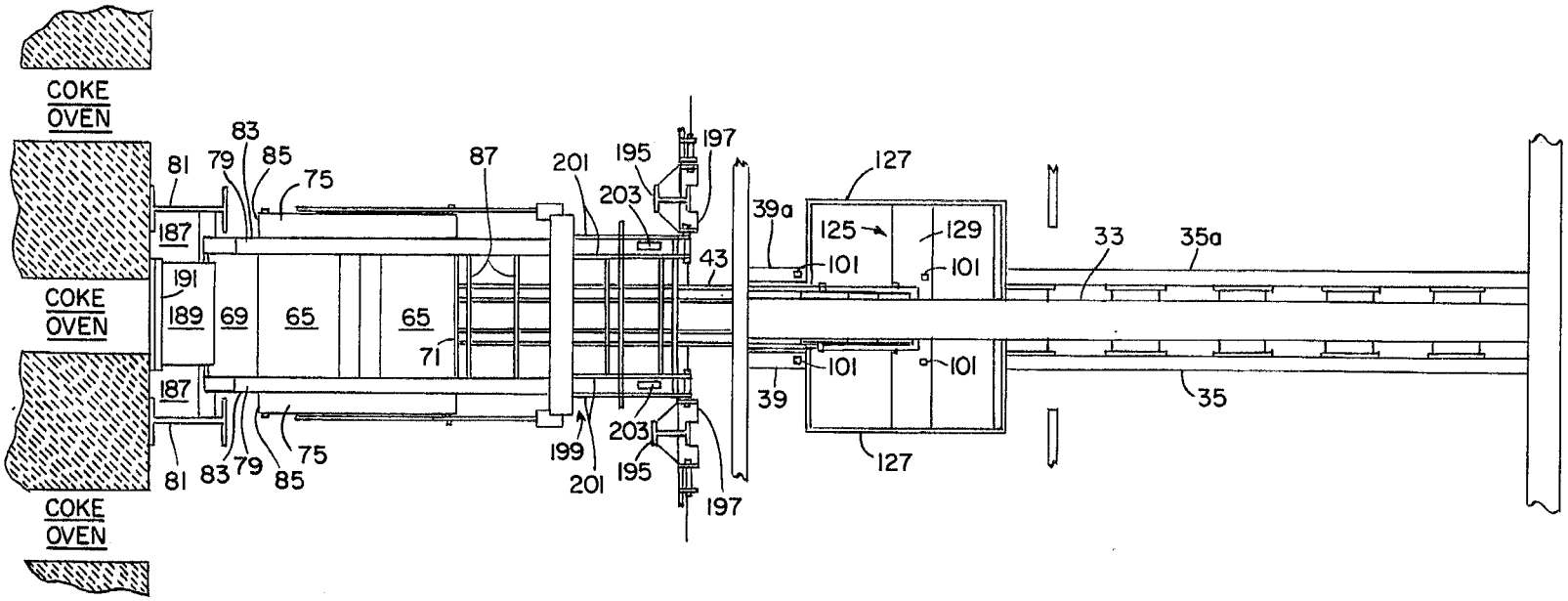
FIG. 2 is a plan view of the invention as seen from II—II of FIG. 1, but with the hopper extended.
Figure 3:
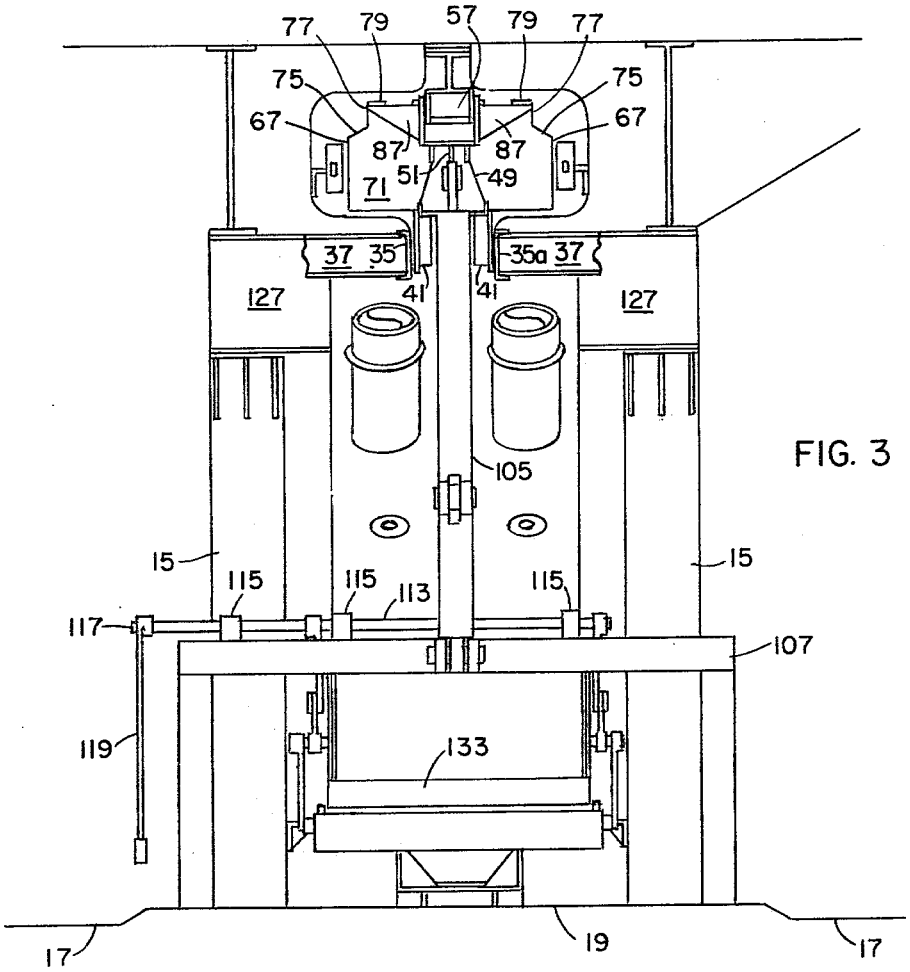
FIG. 3 is a rear end view of the invention as viewed from III—III of FIG. 1, but without the hydraulic cylinder.

Referring to FIG. 3, roller mounting brackets 35, 35*a* are shown a mounted, horizontally and parallel, to supports 37 which, in turn, are fixed to the undercarriage of the pusher machine. In the preferred embodiment, the roller mounting brackets 35, 35*a* are structural channels and the supports 37 are short sections of I-beam. Extension sections 39, 39*a* of the roller mounting brackets 35, 35*a* are, likewise, mounted horizontally and parallel, to supports 37 which, in turn, are fixed to the undercarriage of the pusher machine. A plurality of pairs of flanged rollers 41 are rotatably mounted onto the roller mounting brackets 35, 35*a* and a single pair of flanged rollers 41 is rotatably mounted to the extension sections 39, 39*a*. In the preferred embodiment, there are five pairs of flanged rollers 41 mounted to the roller mounting brackets 35, 35*a* as shown in FIGS. 1 and 2.

An extendible member 43 rides on the flanged rollers 41. In the preferred embodiment, the extendible member 43 includes an upper 45 and lower 47 channel member, both of which are positioned to extend horizontally. The lower channel member 47 rides on the flanged rollers 41 about as shown in FIGS. 1 and 3 and is sized to fit between the flanges of the flanged rollers. The upper channel member 45 is spaced apart from the lower channel member 47 but is fixed to it by way of spacers 49. A vertical rib plate 51 is fixed between the upper 45 and lower 47 channel members at the trailing end 53 of the extendible member.

An idler assembly 55 is mounted to the top of the upper channel member 47 directly above the vertical rib plate 51 and adjacent to the trailing end 53 of the extendible member 43 about where shown in FIG. 1. Referring to FIG. 3, the idler assembly includes at least one idler wheel 57 which has double flanges, one at each of the ends of each idler wheel 57. The idler wheels 57 are rotably mounted in a frame 59 and positioned to track the length of guide rail 33, the flanges being spaced to maintain the idler wheels 57 in contact with guide rail 33. The frame is fixed to the top of upper channel member 45, for example, by welding.

Fixed to the leading end 61 of the extendible member 43 is a hopper 63. Included in the hopper 63 is at least one trap door 65, located to substantially form the hopper floor when closed. In the preferred embodiment there are two trap doors 65 partially mounted to the hopper 63. Preferably, the hopper 63 is formed of two side walls 67, a front wall 69 and a rear wall 71 which is abutted to the leading end 61 of the extendible member 43. As will be noted from viewing FIG. 1, the front wall 69 lower portion is tilted upwardly from the hopper floor and outwardly toward the coke oven battery, thus forming an inclined plane sloping downwardly toward the hopper floor. About mid point in the hopper 63, positioned just above the hopper floor, is a support brace 73, in the form of an angle iron, running between the side walls 67.

Referring to FIG. 3, it will be noted that from the top of each of the side walls 67, an upwardly slanted closure section 75 is extended inwardly toward the center of the hopper 63. From the uppermost and innermost edge of each slanted closure section 75, a vertical sidewall extension 77 is extended. The uppermost edges of these vertical sidewall extensions 77 are at the same elevational level as the uppermost edges of the front wall 69 and rear wall 71. Two flat runner strips 79 are positioned parallel to each other as well as aligned with the pusher ram. Each of these runner strips 79 is fixed adjacent to the respective uppermost edges of the vertical sidewall extensions 71 and extend horizontally inward therefrom toward the center of the hopper 63.

Referring to FIG. 2, it will be noted that the front wall 69 does not extend the full width of the hopper 63. Rather, it extends between the outwardmost edges of the two runner strips 79. This permits the front wall 69 to be extended between the buckstays 81 of the coke oven battery. Thus, the front wall 69 forms a forward extension of the hopper 63. The sides of this forward extension are enclosed by vertical forward extension side covers 83 and the balance of the front of the hopper 63 is covered by vertical front wall extensions 85.

Referring to FIG. 1, it will be noted that the runner strips 79 extend forward from the front wall extensions and are canted downwardly at an angle to meet the uppermost point of the tilted lower portion of the front wall. Also the runner strips 79 extend backward from the hopper 63 toward the trailing end 53 of the extendible member 43. Braces 87 support these backwards extensions of the runner strips 79.

The trap doors 65 are operated by a lever and counterweight arrangement. Referring to FIG. 1, the trap doors 65 are shown in their open position, being pivoted downwardly. Lever 87 is pivotally mounted to the hopper 63 at pivot 89. A counterweight 91 is fixed to the rearmost end of lever 87. Trap Door latches 93 are positioned along the forward portions of lever 87. Corresponding latch hooks 95 are mounted to the side edges 97 of the trap doors 65 and positioned such as when the trap doors 65 are closed, the latch hooks 95 extend upwardly along the exterior of the side walls 67 of the hopper 63. Trip arms 99 are fixed to the undercarriage of the pusher machine and are positioned to, firstly, provide support for rearward portion of the lever 87 and, secondly, to serve as a cam such that, as the hopper 63 and extendible member 43 are moved forward toward the coke oven battery, the counterweights 91 ride up over the trip arms 99, thus depressing the forward end of the levers 87 and pivoting the trap door latches 93 downwardly and rearwardly from the position shown in FIG. 1. Also, the forward movement of the hopper 63 causes the bottoms of the trap doors 65 to engage rollers 101, forcing the open trap doors 65 closed. At the point where the trap doors 65 are closed, the counterweights 91 ride past the trip arms 99, pivoting the trap door latches 93 into engagement with the latch hooks 95, thus causing the trap doors 65 to be maintained in the closed position. When the hopper 63 and the extendible member 43 are retracted rearward, the counterweights 91 engage the trip arms from the opposite direction, releasing the trap door latches 93 from the latch hooks 95, permitting the trap doors 65 to drop open.

At the trailing end 53 of the extendible member 43, a link 103 is pivotably mounted, extending rearward from the trailing end 53. This link 103 is the member which serves to exert force onto the extendable member 43 and the hopper 63, which is fixed thereto, to both extend and retract the hopper 63 in a reciprocating manner. FIG. 1 displays the hopper 63 in its fully retracted position and FIG. 2 displays the hopper 63 in its fully extended position.

The link 103 is pivotably connected, at a point behind the trailing end 53 of the extendible member 43, to one end of a power arm 105. The other end of the power arm is pivotally mounted to a stationary support frame 107 which is rigidly fixed to the leg supports 15. Thus, as power arm 105 pivots at support frame 105, link 103, and consequently the extendible member 43, and hopper 63 are caused to reciprocate.

The pivotation of power arm 105 is caused by double acting hydraulic cylinder 109 in this preferred embodiment, although alternate power sources could be utilized. Cylinder 109 is mounted on cylinder frame 111 which, in turn, is fixed to the undercarriage of the pusher machine.

Referring to FIG. 3, shaft 113 is horizontally mounted to support frame 107 by way of bearings 115 which permit shaft 113 to be pivoted. Fixed to the outboard end 117 of shaft 113 is handle 119 such that when handle 119 is moved, shaft 113 is caused to pivot in bearings 115. Handle 119 may be operated manually or by mechanical means such as, for example, a hydraulic cylinder (not shown).

Referring to FIG. 1, bin 121 is mounted below the retracted position of hopper 63 and trap doors 65 open into the top end 123 of bin 121. Interposed at about mid point of the top end 123 of bin 121, as viewed in FIG. 1, is a separator box 125 which extends through the two sides 127 of bin 121. Separator box 125 lies vertically beneath support brace 73 of hopper 63 when the hopper 63 is in its retracted position as shown in FIG. 1. A pair of the rollers 101 is mounted to the top 129 of separator box 125 so as to coact with one of the trap doors 65 as described hereinbefore. Bin 121 is supported by support channel 13 which extends through separator box 125, through the two sides 127 of bin 121, and is fixed to leg supports 15 on either side of bin 121 about as shown in FIG. 3. The bottom of bin 121 is formed by a pivotal gate 133 which pivots on a pair of pins 135 placed, respectively, on either side 127 of bin 121.

Referring to FIG. 1, lever arm 137 is shown behind handle 119, as exposed by the cut away view of handle 119. Lever arm 137 is fixed to shaft 113 and is positioned parallel to handle 119. Lever extension 139 is pivotably mounted, at its first end, to lever arm 137 at pivot 141 about as shown in FIG. 1. The second end of lever extension 139 is pivotably mounted to oscillating member 143 at pivot 145. The lower end 147 of oscillating member 143 is pivotally mounted to bearing 149 which is stationarily fixed to bin 121 about where shown in FIG. 1. The pivotal mounting of the lower end 147 is by way of stub shaft 151 which is fixed through the lower end 147 but which extends into and is pivotal within bearing 149. An identical arrangement, as described in this paragraph, is positioned on the far side of bin 121, not shown in FIG. 1, but generally shown in FIG. 3.

Lever extension 139 is mounted outboard from pivotal gate 133. However, lever extension 139 includes catch pin 153 which is fixed thereto. Catch pin 153 extends inwardly past the outmost extremity of pivotal gate 133, such that it can engage and pivot pivotal gate 133 open when lever extension 139 is moved rearward, or to the right, as shown in FIG. 1. In operation, as handle 119 is moved rearward, or to the right as shown in FIG. 1, shaft 113 is rotated counterclockwise and, lever arm 137 moves rearward in corresponding motion to handle 119. This causes lever extension 139 to also move, in a generally linear motion, rearward to the point where catch pin 153 engages pivotal gate 133. Further rearward motion to the rear of handle 119 will cause pivotal gate 133 to pivot rearward, opening up the bottom of bin 121. An identical arrangement, as described in this paragraph, is positioned on the far side of the bin 121, not shown in FIG. 1, but generally shown in FIG. 3.

As will be noted on study of FIG. 1, the rearward movement of lever extension 139 will cause oscillating member 143 to pivot clockwise, which, in turn, causes stub shaft 151 to pivot clockwise. At the outboard end of stub shaft 151, pan lever 155 is fixed. Pan lever 155 is longitudinally aligned with oscillating member 143 such that their respective longitudinal axes are parallel. The lowest end 157 of pan lever 155 is pivotally mounted to water catch pan 159. An identical arrangement, as described in this paragraph, is positioned on the far side of bin 121, not shown in FIG. 1, but generally shown in FIG. 3.

Water catch pin 159 is positioned just beneath the bottom of bin 121 at a point where quench water run-off which seeps past pivotal gate 133, even when it is in the closed position as shown in FIG. 1, will be collected. Run-off sluce 161 is fixed to the front end of water catch pan 159 and is in the form of a chute. At the front end of sluce 161, a pair of roller assemblies 163 are mounted. Each roller assembly 163 includes an arm 165 extending vertically and positioned outboard of sluce 161. At the uppermost end of arm 165 is a rotatably mounted roller 167. Fixed to each leg support 15 is a roller track 169 positioned about as shown in FIGS. 1 and 3. Each roller 167 coacts with and rolls on its adjacent tract 169 such that water catch pan 159 and sluce 169, fixed thereto, are supported by the roller assemblies 163 and are permitted to reciprocate forwards and backwards for the length of the roller tracks 169.

As mentioned before, the operation of handle 119 produces pivotation of stub shafts 151. Because pan levers 155 are also fixed to stub shafts 151, when stub shafts 151 pivot, pan levers 155 oscillate correspondingly. The oscillation of pan levers 155 causes water catch pan 159, to which the lowest ends 157 of pan levers 155 are pivotally mounted, to reciprocate forwards and backwards. Movement of water catch pan 159 forward produces clearance for the dumping of material in bin 121 when pivotal gate 133 is opened.

A shield 171 is stationarily mounted between leg supports 15 and positioned forward and just below the front end of sluce 161 as shown in FIG. 1. The width of shield 171 is greater than the width of sluce 161, permitting sluce 161 to telescope into shield 171 when water catch pan 159 and sluce 161 are moved forward. Shield 171 generally serves as a chute extension to carry quench water run-off from the water catch pan 159 and sluce 161 to a position forward of the leg supports 15.

At the base of the bench supports 25, just forward of the leg supports 15 and beneath the forward end of the shield, a trough 173 is formed in the concrete beneath the pusher machine, running the full length of the coke oven battery and sloped slightly to discharge water therein at one end or the other of trough 173. Quench water run-off from shield 171 empties into trough 173 to be discharged at a remote location.

The quench water is produced by a plurality of spray nozzles 175 positioned on the rear wall 177 of bin 121. The spray nozzles 175 are connected to water conduits 179 which, in turn, are supplied by a pump means (not shown) at a remote location. The lower portion of the front wall 181 of bin 121 is sloped rearward as shown in FIG. 1 to permit material dropped into bin 121 to spread out and slide to the bottom thereof and collect on the inner side of pivotal gate 133. As this material is so dispersed, it can be sprayed with quench water from the spray nozzles 175 which are positioned advantageously to direct water onto the dispersed material.

In operation, the pusher machine is positioned in alignment with the oven to be pushed. Extendible member 43 and hopper 63 are extended forward by energizing hydraulic cylinder 109. In its extended, or forward, position, as shown in FIG. 2, hopper 63 engages the lower lip of the particular oven to be pushed. Rider wheel 183 engages lip 185 to help steady and support hopper 63 in its extended position. Lip 185 is fixed to shield 187 which is fixed between the buckstays 81 of the coke oven battery. Shield 187 serves to prevent material from falling down between the buckstays 81 behind and underneath the bench platform 23. Above shield 187 is positioned slide 189 which is inclined outwardly and downwardly from door jamb 191 of the subject coke oven. In the extended hopper 63 position, the lower edge of slide 189 extends over the upper edge of the front wall 69 and between forward extension side covers 83 and downwardly canted ends of the runner strips 79, all as shown in FIG. 2.

After the extendible member 43 and hopper 63 have been fully extended, the door extractor (not shown), mounted on the pusher machine, removes the coke oven door, pivots it sideways to be cleaned, and operation of the pusher ram (not shown) is commenced. When the door is removed, some of the red hot coke in the oven spills out. This material then tumbles down slide 189 into hopper 63. The pusher arm is extended through the coke oven, pushing the coke therein through a doorway at the other end of the battery. Residual amounts of coke fall behind the pusher ram head and shoe during this operation, and when the pusher arm is retracted back through the coke oven, this residual red hot coke is dragged with it to fall out of the pusher side doorway. This material, likewise, tumbles down slide 189 and into hopper 63.

Following the retraction of the pusher ram, a door jamb cleaner (not shown) is brought into alignment with the coke oven, and the door jamb is scraped to remove tar and residue buildup. This scraped material also tumbles down slide 189 into hopper 63.

Hopper 63 and extendible member 43 then are retracted, concurrent with the replacement of the coke oven door. When hopper 63 and extendible member 43 are almost retracted, counterweight 91 engages trip arm 99 and rides up over it, causing lever 87 to pivot, releasing trap door latches 93 from latch hooks 95 and allowing trap doors 65 to drop open into the top end 123 of bin 121. The material in hopper 63, mostly red hot coke, falls into bin 121, hitting, firstly, the inside of front wall 181 where it tends to break up and disperse. As this occurs, quench water is pumped, by way of conduits 179 through spray nozzles 175, onto the red hot coke to cool and quench it. This quenching operation produces a large amount of gas and particulate laden steam within bin 121. Suction mains 195 mounted through rear wall 177 of bin 121 draw off this steam for cleansing at a remote location.

When bin 121 becomes filled, after several pushes, the pusher machine is moved to the end of the coke oven battery where the material in bin 121 is discharged.

Figure 5:
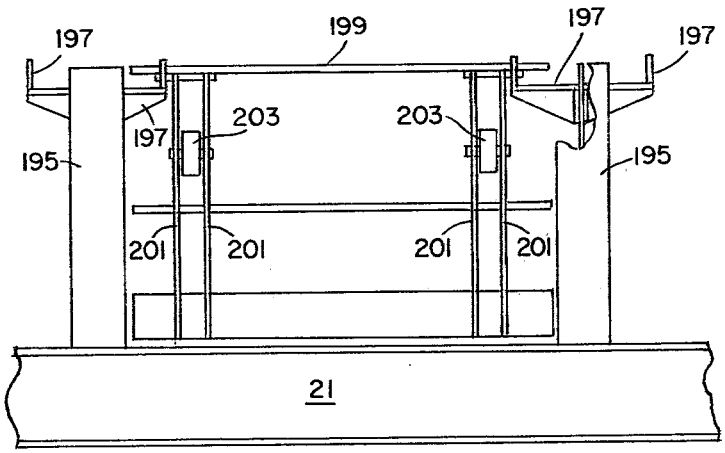
FIG. 5 is an enlarged sectional rear end view of a portion of the pusher side bench and the adjacent pivotable hand rail assembly as viewed from V—V of FIG. 1.

As mentioned previously, at the outer edge of the bench platform 23, adjacent to the pusher machine, as shown in FIG. 1, is a hand railing assembly 27. The hand railing assembly 27 extends the full length of the bench platform. Referring to FIG. 5, the hand railing assembly includes a plurality of structural uprights 195, one for each buckstay 81. The structural uprights 195 are aligned with the respective buckstays 81 such that the axis of alignment thereof is parallel to the longitudinal axis of the coke ovens. Both the buckstays 81 and the structural uprights 195 are axially positioned in between the doorways of adjacent coke ovens, as shown in FIG. 2.

Referring to FIG. 5, each of the uprights 195 has, mounted near its top, a pair of swivel mounting brackets 197, each bracket 197, of a pair, being mounted on opposite sides, respectively, upon upright 195.

A gate 199 is pivotally suspended between each two successive uprights 195, being mounted to pivot or swing on a horizontal axis between opposed swivel mounting brackets 197 mounted, respectively, on each of the two successive uprights 195. Each of the gates 199 has two pairs of vertical struts 201. Between each pair of vertical struts 201 is rotatably mounted a gate roller 203. The two pairs of vertical struts 201, on each gate 199, and, consequentially, the two gate rollers 203 of each gate, are aligned with the runner strips 79 which are fixed adjacent to the uppermost edges of the vertical sidewall extensions 71 of the hopper 63. The forwardmost edge of the downwardly canted forward ends of the runner strips 79 are positioned at a lower elevation than the gate rollers 203.

Figure 4:
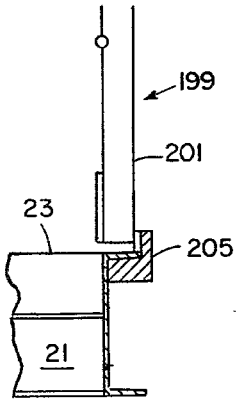
FIG. 4 is an enlarged sectional side view of a portion of the pusher side bench and the adjacent pivotble hand rail assembly as at IV of FIG. 1.

In operation, as extendible member 43 and hopper 63 are extended forward, the downwardly canted forward ends of the runner strips 79 come into contact with the gate rollers 203, forcing the gate 199 to swing upwardly on swivel mounting brackets 197, thus allowing hopper 63 to move under the gate. Gate rollers 203 continue to ride on runner strips 79, maintaining the gate 199 in the upward position until extendible member 43 and hopper 63 have been retracted. Gate 199 is prevented from swinging in the opposite or outward direction away from the coke oven by stopper 205 as shown in FIG. 4. Thus, when the gates 199 are in their downward or vertical position, they serve as a hand railing assembly 27 to prevent people who are on the bench platform 23 from falling off.

According to the patent statutes, the principle, preferred embodiment, and best mode of operation of the present invention have been illustrated and described. However, it is to be understood that, within the scope of the appended claims, the invention may be practiced otherwise than as specifically illustrated and described.

What is claimed is:

1. In a coke oven pusher machine, including a pusher ram and a door machine, the improvement comprising:

(a) hopper means, mounted to the undercarriage of said pusher machine and operable to be extended to a position adjacent to the lower edges of the pusher side doorways of the coke ovens of the coke oven battery with which the coke oven pusher machine is associated, to collect material spilled from said coke ovens;

(b) powered means, mounted to said pusher machine, for extending said hopper means to said position adjacent and for retracting said hopper means to within said undercarriage of said pusher machine;

(c) gravity release means, mounted to the bottom of said hopper means, operable to release said material from within said hopper means, when said hopper means has been retracted to within said undercarriage of said pusher machine;

(d) bin means, mounted to said undercarriage of said pusher machine, positioned beneath the retracted position of said hopper means, operable to collect said material released from said hopper means by said gravity release means;

(e) gate means, mounted to the bottom of said bin means, operable to dump said material which becomes accumulated within said bin means, said gate means which permits the flow of water therethrough from within said bin means;

(f) quench water spray means, mounted to said bin means, operable to spray water onto said material within said bin means; and (g) conduit means, mounted to said bin means, operable to conduct away gases and airborne particulates which emanate from said material within said bin means.

2. A system for collecting and disposing of coke oven battery pusher side door spillage, wherein said coke oven battery includes a pusher machine, a plurality of horizontal slot-type coke ovens and a pusher side bench, comprising (a) hopper means, mounted to the undercarriage of said pusher machine and operable to be extended to a position adjacent to the lower edges of the pusher side doorways of said coke ovens to collect material spilled from said coke ovens;

(b) powered means, mounted to said pusher machine, for extending said hopper means to said position adjacent and for retracting said hopper means to within said undercarriage of said pusher machine;

(c) gravity release means, mounted to the bottom of said hopper means, operable to release said material from within said hopper means when said hopper means has been retracted to within said undercarriage of said pusher machine;

(d) bin means, mounted to said undercarriage of said pusher machine, positioned beneath the retracted position of said hopper means, operable to collect said material released from within said hopper means by said gravity release means;

(e) gate means, mounted to the bottom of said bin means, operable to dump said material which becomes accumulated within said bin means, said gate means which permits the flow of water therethrough from within said bin means;

(f) quench water spray means, mounted to said bin means, operable to spray water onto said material within said bin means;

(g) conduit means, mounted to said bin means, operable to conduct away gases and airborne particulates which emanate from said material within said bin means;

(h) trough means, located adjacent the base of said coke oven battery and extending the length thereof along the pusher side bench, operable to continuously drain off water which flows from said bin means through said gate means;

(i) slide means, positioned adjacent said lower edges of said pusher side doorways of said coke ovens, operable to direct material spilled from said coke ovens into said hopper means; and (j) pivotable hand rail means, extending the length of the outboard edge of said pusher side bench, arranged to pivot out of the way as said hopper means is extended to said position adjacent and to return pivot as said hopper means is retracted to within said undercarriage of said pusher machine.

3. The invention described in claim 2 wherein said hopper means comprises an open topped hopper fixed to an extendible member.

4. The invention described in claim 2 wherein said powered means comprises an hydraulic cylinder operable on said hopper means.

5. The invention described in claim 2 wherein said gravity release means includes at least one trap door pivotally mounted to the bottom of said hopper means.

6. The invention described in claim 2 wherein said gates means is loosely fit to the bottom of said bin means so as to permit the flow of water therethrough.

7. The invention described in claim 2 wherein said bin means includes at least one sloped side operable to disburse said material falling thereon which is released from said hopper means by said gravity release means.

8. The invention described in claim 7 wherein said quench water spray means are positioned to spray water onto said material as it is disbursed by said at least one sloped side.

* * * * *